US011262173B2

(12) United States Patent
Labenda et al.

(10) Patent No.: US 11,262,173 B2
(45) Date of Patent: Mar. 1, 2022

(54) PERCUSSION FUSE

(71) Applicant: Rheinmetall Waffe Munition GmbH, Unterlüß (DE)

(72) Inventors: Thomas Labenda, Breisach am Rhein (DE); Klaus Deutschkämer, Mahlberg (DE)

(73) Assignee: Rheinmetall Waffe Munition GmbH, Unterlüß (DE)

( * ) Notice: Subject to any disclaimer, the term of this patent is extended or adjusted under 35 U.S.C. 154(b) by 0 days.

(21) Appl. No.: 17/276,508

(22) PCT Filed: Aug. 27, 2019

(86) PCT No.: PCT/EP2019/072858
§ 371 (c)(1),
(2) Date: Mar. 16, 2021

(87) PCT Pub. No.: WO2020/064246
PCT Pub. Date: Apr. 2, 2020

(65) Prior Publication Data

US 2022/0034638 A1 Feb. 3, 2022

(30) Foreign Application Priority Data

Sep. 27, 2018 (DE) ..... 10 2018 123 935.1

(51) Int. Cl.
*F42C 1/10* (2006.01)
*F42C 15/24* (2006.01)
(Continued)

(52) U.S. Cl.
CPC ..... *F42C 15/24* (2013.01); *F42C 1/10* (2013.01); *F42C 15/40* (2013.01); *F42C 1/00* (2013.01)

(58) Field of Classification Search
CPC .. F42C 1/10; F42C 11/02; F42C 15/40; F42C 19/14
See application file for complete search history.

(56) References Cited

U.S. PATENT DOCUMENTS 4,434,717 A 3/1984 Erickson
4,445,434 A 5/1984 Brede et al.
(Continued)

FOREIGN PATENT DOCUMENTS

DE 10013939 A1 9/2001
DE 10 2009 058 718 A1 6/2011
EP 2758746 B1 8/2017

OTHER PUBLICATIONS

International Search Report from corresponding PCT Application No. PCT/EP2019/072858, dated Nov. 22, 2019.

*Primary Examiner* — J. Woodrow Eldred
(74) *Attorney, Agent, or Firm* — Harness, Dickey & Pierce, P.L.C.

(57) ABSTRACT

The invention relates to a percussion fuse having an active sensor, which generates a sensor voltage, having a filter circuit consisting of a high pass and at least one low pass, in order to be able to adjust dynamic percussion characteristics. The invention further relates to an operating state switch, which can transition the percussion fuse into one of two operating states, specifically into an activated and a deactivated operating state. To this end, the operating state switch is switched into one of the two operating states by means of a safety voltage. In the active operating state, the sensor voltage is supplied directly to the threshold value switch and in the deactivated operating state, the sensor voltage is held below the threshold value of the threshold value switch by an input limiter.

16 Claims, 1 Drawing Sheet

(51) Int. Cl.
*F42C 15/40* (2006.01)
*F42C 1/00* (2006.01)

(56) References Cited

U.S. PATENT DOCUMENTS

| | | | | |
|---|---|---|---|---|
| 5,301,613 | A * | 4/1994 | Muirhead | F42C 11/02 102/210 |
| 8,091,478 | B1 | 1/2012 | Khuc et al. | |
| 2007/0204756 | A1 | 9/2007 | Rastegar et al. | |
| 2015/0192397 | A1* | 7/2015 | DeVries | F42C 15/40 102/218 |
| 2018/0252743 | A1* | 9/2018 | Rastegar | G01B 21/08 |
| 2021/0003376 | A1* | 1/2021 | Holm | F42C 11/002 |

* cited by examiner

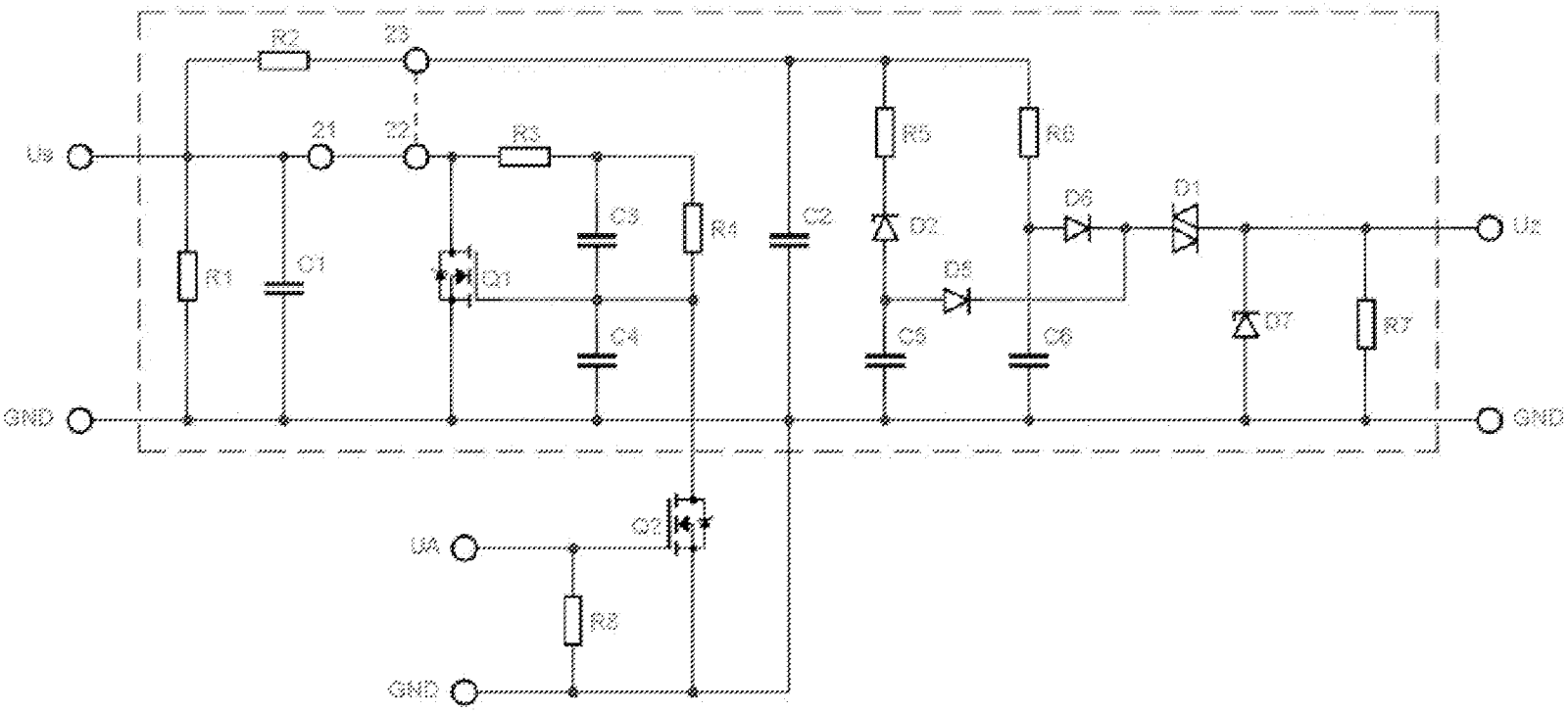
UB
GND
R7
D7
D5
D4
R8
C5
D6
R10
D3
C6
C2
R4
C3
C4
R2
Q1
Z2
Z1
R3
C1
R1
UA
GND
R6
Q2
UB
GND

PERCUSSION FUSE

CROSS-REFERENCE TO RELATED APPLICATIONS

This application is a national phase application of PCT Application No. PCT/EP2019/072858, filed on 27 Aug. 2019, which claims the benefit of and priority to German Patent Application No. 10 2018 123 935.1, filed on 27 Sep. 2018. The entire disclosures of the applications identified in this paragraph are incorporated herein by references.

FIELD

The present invention relates to a percussion fuse, as used in munitions. The purpose of the percussion fuse is to safely activate the active charge, which is provided in the munition, when the munition strikes a target and to directly or indirectly initiate the firing of the active charge. Directly means that a detonator is fired, for example. Indirectly means that a switch is controlled in order to connect the detonator to the firing energy.

BACKGROUND

Impacts of a particular munition on different underlying surfaces have a large dynamic range in terms of amplitude and frequency, which must be completely and safely detected, but can result in triggering only within specified limits. In this case, dynamic detection means that short, severe impacts must be detected just as safely as longer, softer impacts, in which case the impact on particular targets is intended to trigger firing and other obstacles do not trigger any firing. Consequently, the sensitivity and the response behavior of the percussion fuse must be adjusted to different targets.

SUMMARY

The object of the present invention is therefore to provide a percussion fuse which fires only when it strikes its target and does not already fire upon firing or as a result of forces acting on the munition during the flying time. This object is achieved by means of the features of the present main claim.

The functional units are explained in succession in the following paragraphs:

Sensor

A percussion fuse having an active sensor which can convert mechanical energy into electrostatic energy, that is to say into a sensor voltage, is proposed. A piezo sensor which converts mechanical effects on the piezoelectric material into electrical charge, resulting from dipole formation in the crystal structure, is advantageously proposed for this purpose. A capacitor and a resistor which together form a high-pass filter in order to set the lower cut-off frequency follow in parallel with the sensor input of the circuit.

However, the main function of the capacitor is to convert the charge of the piezo sensor into a voltage. The capacitance then determines the sensitivity to the greatest possible extent.

The percussion fuse also has a filter characteristic comprising a high-pass filter and at least one low-pass filter in a downstream filter circuit which is explained later.

Operating State Switch

The proposed percussion fuse also comprises an operating state switch which can change the percussion fuse to one of two operating states, namely an activated operating state and a deactivated operating state. This is carried out by means of an activation voltage which can be supplied to the operating state switch. The percussion fuse is changed to an activated operating state (live) via this activation voltage and is changed to the deactivated (safe) operating state without an activation voltage.

The operating state switch is preferably configured in such a manner that the activated state is achieved when the activation voltage is applied and the deactivated state of the percussion fuse is achieved when the activation voltage is not applied. So that this deactivated state of the percussion fuse is safely maintained, that is to say when an activation voltage is not applied, potential coupling is provided in one particular embodiment, which potential coupling uses the existing ground potential to configure the input limitation controlled by the operating state switch in such a manner that it can become active and therefore safely keeps the percussion fuse in the deactivated (safe) operating state.

The activation voltage for the operating state switch can be advantageously buffered. In one preferred embodiment, this is possible by means of a capacitor and a resistor (low-pass filter). The capacitor ensures that the applied activation voltage is maintained for a short time if the latter disappears. The state of the deactivated input limitation is therefore also briefly maintained, which ensures that the active function of the percussion circuit is retained. The electrostatic energy is removed via the resistor of the buffer.

Input Limitation

The input limitation is preferably configured in such a manner that the energy from the active sensor is limited or removed downstream of a first low-pass filter of the electronic circuit. This is achieved by short-circuiting the voltage in a certain range. As a result of this intentional short circuit, the sensor voltage can therefore no longer be supplied to a threshold value switch.

In one particular embodiment, it is proposed to preferably short-circuit the input signal by means of a MOSFET component which is connected in parallel with the active sensor or downstream of the first low-pass filter. Input limitation of this type can then be limited positive voltages to its by virtue of the structural character of the MOSFET component. In the activated operating state, under the control of the operating state switch, this MOSFET is then turned off, with the result that it is no longer possible to short-circuit a positive sensor voltage. The full sensor voltage is accordingly then applied to the downstream filter circuits. Negative sensor voltage is always limited by the source-drain diode of the MOSFET. This limitation is independent of the operating state.

Filter Circuits

A capacitor and a resistor are arranged in parallel with the sensor input of the percussion fuse. The capacitor converts the electrical charge signal from the sensor into a proportional voltage signal. The capacitor voltage varies with the dimensioning of the capacitor capacitance and can therefore be used to set the sensitivity. The resistor short-circuits static voltages and forms a high-pass filter with the capacitor. The capacitor and the resistor thus determine the lower first-order cut-off frequency.

This high-pass characteristic of the circuit is used to sufficiently attenuate low frequencies, which can occur as a result of physical behavior during the flight of the munition for example, and to compensate for the zero point drift so that they cannot result in the initiation of the fuse.

The prefiltered sensor voltage is passed to a first-order low-pass filter. The first low-pass filter is not absolutely necessary, but is used such that dynamic negative sensor voltages are not short-circuited by the input limitation. The output signal from the first low-pass filter then branches into two further low-pass filters.

In order to be able to correctly react to different sensor signals, that is to say dynamically with low sensitivity and quasi-dynamically with high sensitivity (that is to say to output a trigger voltage for the firing), the output signal from the first low-pass filter is passed to 2 parallel low-pass filters with a different transmission behavior.

The 2 parallel low-pass filters detect sensor signals for different target types.

Threshold Value Switch

A threshold value switch which blocks the voltage signals from the low-pass filter outputs below a certain threshold value is also provided. If the voltage signal reaches or exceeds the threshold value, the threshold value switch switches the voltage signals through and forwards them as a firing voltage for firing the munition. The threshold value switch prevents firing as a result of smaller voltage pulses which are not caused by the percussion fuse striking the desired target.

It has been found to be advantageous to embody the threshold value switch as a trigger diode since it is not very susceptible to faults and is relatively cost-effective. Alternatively, the threshold value switch may also comprise a circuit having discrete components.

Voltage Limitation Downstream of the Threshold Value Switch

In order to ensure the above-mentioned uniform firing, one particular embodiment likewise provides voltage limitation which limits the firing voltage. This is advantageous if the firing voltage forwarded by the threshold value switch is too high or contains excessively high voltage peaks. A Zener diode which limits the firing voltage to the Zener voltage has proved to be advantageous for this purpose. A suppressor diode which has a faster reaction time than the conventional Zener diode can also be used here in a particularly advantageous manner.

The resistor R7 compensates for leakage currents.

BRIEF DESCRIPTION OF THE DRAWINGS

Further features emerge from the accompanying drawings, in which:

FIG. 1 shows an exemplary circuit diagram of a percussion fuse according to the invention.

DETAILED DESCRIPTION

FIG. 1 shows the percussion fuse according to the invention, wherein the active sensor which may be a piezo sensor, for example, is not shown. The sensor is connected to GND at the two points of the sensor voltage $U_S$ and provides electrostatic energy $E_{el}$. This electrostatic energy is supplied, in the form of charge, to the capacitor C1 directly at the input of the sensor voltage $U_S$ and is converted into a proportional electrical voltage in the capacitor. This voltage, stored charge, is used for the further connection of the percussion fuse.

The invention is divided into two operating states, an activated state and a deactivated state.

The operating states are switched over via an operating state switch Q2. The latter is in the form of an NMOSFET in the present case. This NMOSFET is used as an electronic switch and can deactivate the input limitation Q1 when the activation voltage $U_A$ is applied.

Potential coupling R8 which keeps the potential at ground potential when the activation voltage $U_A$ disappears is introduced in parallel with the activation voltage $U_A$. As a result, the percussion fuse is deactivated, that is to say changed to a safe state.

When the operating state switch Q2 is activated, the operating state switch Q2 in FIG. 1 connects the gate of the transistor Q1 to ground. The transistor Q1 can no longer turn on and therefore will no longer limit the sensor voltage to less than approximately 3 V. This operating state switch Q2 is controlled by the fuse electronics or the voltage $U_A$.

Controlled in the deactivated operating state, the MOSFET, as the input limitation Q1, is then no longer turned off by the operating state switch Q2, with the result that the capacitor C4 is charged in the case of a positive sensor voltage.

If the capacitor voltage of the capacitor C4 exceeds the threshold gate-source voltage of the input limitation Q1 after a short delay caused by the resistor R3, the input limitation Q1 turns on and then short-circuits the voltage to the downstream filters. The threshold value switch D1 does not receive any voltage for connection. This function is supplied by the active sensor.

The circuit advantageously need not be externally supplied, with the result that the energy from the active sensor is sufficient to generate the firing pulse of the firing voltage $U_Z$. If the threshold value switch D1 turns on, the energy stored in the low-pass filters C5+R5 and C6+R6 is large enough to guarantee a trigger pulse even in the event of an additional trigger delay. A so-called pump effect is not possible as a result.

The above-mentioned pump effect occurs if shockwaves run through the munition body during impact of the munition, which is the case with hard targets, in particular. These shockwaves generate an oscillating signal from the active sensor and therefore an oscillating sensor voltage. In conventional percussion fuses, the firing pulse can be suspended or delayed as a result.

The input limitation Q1 is preferably likewise in the form of an NMOSFET. In order to now safely keep this sensor voltage below the threshold value, the input limitation Q1 is arranged in parallel with the sensor voltage $U_S$ or downstream of the first low-pass filter (drain Q1 at the capacitor C2). If there is now a positive sensor voltage $U_S$, the capacitor C4 is charged between the gate and the source. If the NMOSFET exceeds its threshold gate-source voltage, it turns on between the drain and the source with a very low resistance. The input limitation which is now on short-circuits the sensor voltage $U_S$ to the threshold gate voltage. A negative sensor voltage $U_S$ is likewise limited by the drain-source diode. Assuming that the diode voltage is 0.7 V and the threshold gate voltage of the input limitation has a value of 3.5 V, the sensor voltage $U_S$ is therefore limited to values of between −0.7 V and 3.5 V. For this reason, the downstream threshold value switch has a higher breakdown voltage (breakover) than 3.5 V, for example 20 V.

If an activation voltage $U_A$ is applied, the input limitation Q1 is changed to the deactivated state by the operating state switch Q2, with the result that there is no longer any voltage limitation of the sensor voltage $U_S$. In this case, the full sensor voltage $U_S$ or the proportional voltage applied to the capacitor C1 is passed, through the downstream low-pass filter group, to the threshold value switch D1. In the present FIGURE, this threshold value switch D1 is in the form of a trigger diode which operates with a breakdown voltage of 20 V, for example. This means that voltage signals of the sensor voltage $U_S$ below 20 V are not passed through the trigger diode but voltage signals above 20 V are passed through the trigger diode. The drain-source diode of the NMOSFET still remains active, with the result that the sensor voltage $U_S$ is still limited to 0.7 V in the negative case, irrespective of the operating state of the percussion fuse. The current through the drain-source diode results in a zero point shift.

The high-pass filter connected downstream of the sensor input $U_S$ comprises the capacitor C1 and the resistor R1. A low-pass filter C2+R2 which is arranged between the high-pass filter C1+R1 and the threshold value switch D1 then follows. This low-pass filter C2+R2 ensures that high frequencies which are likewise not intended to result in the firing of the percussion fuse are likewise filtered out from the sensor voltage $U_S$. 2 different further low-pass filters are connected downstream of this first low-pass filter.

The low-pass filter branch (C5, R5, with a low time constant) is for the strong signal components (hard targets) and has a reverse-biased Zener diode D2 in series. This reduces the voltage supplied to the filter C5, R5 by the Zener voltage of the Zener diode D2. The Zener diode D2 also prevents charge from flowing into the capacitor C5 in the case of a low voltage level and the overall sensitivity being reduced thereby because this part of the charge would be missing in the capacitor C6. Only at a sufficiently high level is the capacitor C5 charged to the trigger voltage of the threshold value switch D1 which then switches the capacitor voltage through to the output Uz.

The second low-pass filter C5+R5 is then assigned to the output signal, that is to say the firing voltage $U_Z$, and filters high frequencies from the firing voltage $U_Z$. The low-pass filter additionally has a Zener diode D2 in series with the resistor R5. The Zener diode D2 reduces the input voltage of the low-pass filter by the Zener voltage.

The low-pass filter branch (C6, R6) for the weaker signal components has a higher time constant, with the result that the capacitor C6 can be charged more slowly to the trigger voltage of the threshold value switch D1. The latter then likewise switches the capacitor voltage C6 through to the output Uz. There is no voltage-reducing Zener diode in this low-pass filter branch, and even small amplitudes can therefore contribute to charging C6.

A diode (D5 and D6) at the output of each low-pass filter branch respectively decouples the output voltages and prevents the mutual influence of the two filters. Dynamic signals are filtered by the two filters and are not supplied to the threshold value switch D1.

The voltage limitation D7 of the firing voltage $U_Z$ ideally limits the firing voltage $U_Z$ to a value which is slightly above the threshold value voltage of the threshold value switch D1.

The special feature of this embodiment is that the input voltage, that is to say the sensor voltage $U_S$, of the first low-pass filter C2+R2 is not limited. A hard target or a high munition speed also results in a long delay, with the result that the active sensor provides a large amount of energy in the form of charge in a short time, which energy is converted into a high voltage pulse in the capacitor C1. A high voltage shortens the time needed to charge the first low-pass capacitor C2 and to turn on the threshold value switch D1. The firing pulse is therefore highly dynamic. If the target is soft or the munition is slower, the trigger pulse, that is to say the firing voltage $U_Z$, is also slightly delayed. The trigger characteristic of the percussion fuse can therefore be set within certain limits by means of correct parameterization, that is to say setting of the filters.

In order to limit the firing voltage $U_Z$ provided when turning on the threshold value switch D1 to a certain value, voltage limitation D7 is provided, by means of a Zener diode or a suppressor diode in the present case. Voltages above the breakdown voltage of this Zener or suppressor diode are short-circuited via the diode, with the result that the firing voltage $U_Z$ is limited to a maximum voltage.

A diode D2 is also provided in series with the firing voltage $U_Z$ and is intended to protect the electronic circuit of the percussion fuse from currents which have been fed back.

So that the input limitation (Q1) can be arranged in a simple manner upstream or downstream of the resistor (R2) of the low-pass filter, disconnection of the connections 21-22 and connection of the connections 22-23 are provided.

The present invention is not restricted to the features mentioned above, but rather further embodiments are conceivable. It would be possible to provide a fuse which only activates the percussion function of the fuse after a programmed time. The transfer function could be programmable and/or higher-order low-pass and high-pass filters could likewise be used to more accurately set the percussion characteristic, that is to say is to set the dynamic response.

LIST OF REFERENCE SIGNS $U_S$ Sensor voltage
$U_V$ Safety voltage
$U_Z$ Firing voltage
C1+R1 High-pass filter
C2+R2 Low-pass filter
C5+R5 First low-pass filter
C6+R6 Second low-pass filter
R8 Potential coupling
C3+C4+R3 Low-pass filter for Q1
C3+R4 High-pass filter for Q1
D1 Threshold value switch
D2 Zener diode
D3+D4 Decoupling diodes
D5 Voltage limitation
Q1 Input limitation
Q2 Operating state switch
R7 Leakage current compensation of D1

What is claimed is:

1. A percussion fuse having an active sensor which can convert mechanical energy into electrostatic energy which can be used to generate a sensor voltage ($U_S$), having a threshold value switch (D1) which blocks voltage signals below a threshold value and forwards voltage signals above the threshold value as a firing voltage ($U_Z$), wherein a filter circuit comprising a high-pass filter (C1+R1) and at least one first low-pass filter (C6+R6) is provided, in that the filter circuit filters out low and high frequencies in the sensor voltage ($U_S$), in that an operating state switch (Q2) is provided and can change the percussion fuse to one of two operating states, namely an activated operating state and a deactivated operating state, by means of a safety voltage ($U_V$), wherein the sensor voltage ($U_S$) is supplied to the threshold value switch (D1) in the activated operating state and the sensor voltage ($U_S$) is limited, via input limitation (Q1), to below the threshold value of threshold value switch (D1) in the deactivated operating state.

2. The percussion fuse as claimed in claim 1, wherein the input limitation (Q1) is arranged upstream or downstream of the resistor (R2) of the low-pass filter.

3. The percussion fuse as claimed in claim 1, wherein two low-pass filters (C5+R5, C6+R6) are provided, the outputs of which can each be combined via a diode (D5, D6).

4. The percussion fuse as claimed in claim 3, wherein the two low-pass filters (C5+R5, C6+R6), when arranged in a parallel manner, a voltage barrier which is in series with the low-pass filter resistor is arranged, preferably as a Zener diode (in the reverse direction), for each low-pass filter.

5. The percussion fuse as claimed in claim 1, wherein the filters are programmable and can be connected and disconnected or adjusted.

6. The percussion fuse as claimed in claim 1, wherein capacitors (C3, C4) are provided and reduce the switch-on delay caused by the resistor R3 of the input limitation Q1.

7. The percussion fuse as claimed in claim 1, wherein a resistor R7 is provided in order to compensate for leakage currents of the threshold value switch (D1).

8. The percussion fuse as claimed in claim 1, wherein a buffer (for example capacitor in parallel with R8) is provided for the operating state switch (Q2) and retains the electrical state of the operating state switch (Q2) for a short time even in the event of a change.

9. The percussion fuse as claimed in claim 1, wherein potential coupling (R8) is provided and sets the activation voltage ($U_A$) for the operating state switch (Q2) to a ground potential if no activation voltage ($U_A$) is actively supplied to the percussion fuse.

10. The percussion fuse as claimed in claim 1, wherein the threshold value switch (D1) is implemented by means of an electronic circuit or a trigger diode (DIAC) is used as the threshold value switch (D1).

11. The percussion fuse as claimed in claim 1, wherein transistors are used as the input limitation (Q1) and/or as the operating state switch (Q2), wherein reverse-biased diodes can be provided in parallel with the collector and emitter inputs in the transistors.

12. The percussion fuse as claimed in claim 1, wherein a Zener diode, in particular a suppressor diode, is used as voltage limitation (D2).

13. The percussion fuse as claimed in claim 1, wherein the operating state switch (Q2) is in the form of an electronic switch or a relay contact.

14. The percussion fuse as claimed in claim 1, wherein the output of the percussion fuse ($U_Z$) directly or indirectly initiates the active substance, usually the detonator.

15. The percussion fuse as claimed in claim 1, wherein further filters can be integrated in the circuit in order to produce a complex transfer function.

16. The percussion fuse as claimed in claim 1, wherein the input limitation (Q1) is in the form of a MOSFET and limits the positive sensor voltage ($U_S$) to the maximum drain-source voltage and limits the negative sensor voltage ($U_S$) to −0.7 V.

* * * * *